US006654472B1

(12) United States Patent
Jeon

(10) Patent No.: US 6,654,472 B1
(45) Date of Patent: Nov. 25, 2003

(54) SPEAKER SYSTEM IN DISPLAY

(75) Inventor: Chang Wook Jeon, Kyongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/599,421

(22) Filed: Jun. 22, 2000

(30) Foreign Application Priority Data

Jun. 26, 1999 (KR) ..... 1999-24457

(51) Int. Cl.[7] ..... H04R 25/00
(52) U.S. Cl. ..... 381/349; 381/388
(58) Field of Search ..... 381/349, 345, 381/337, 338, 339, 340, 388; 181/156, 199

(56) References Cited

U.S. PATENT DOCUMENTS 4,201,274 A * 5/1980 carlton
4,997,057 A * 3/1991 Furukawa ..... 181/160
5,115,473 A * 5/1992 Yamagishi et al.
5,436,977 A * 7/1995 sato ..... 381/154
5,513,270 A * 4/1996 Lewis
5,550,921 A * 8/1996 freadman
5,825,900 A * 10/1998 Jeon ..... 381/154

FOREIGN PATENT DOCUMENTS

JP 9074595 3/1997
KR 1019990198290 2/1999

* cited by examiner

*Primary Examiner*—Sinh Tran
(74) *Attorney, Agent, or Firm*—Fleshner & Kim, LLP

(57) ABSTRACT

Speaker system in a display including a speaker for presenting a sound, a rear sound box coupled to a back of the speaker, and a changeable duct disposed to pass through a front surface of the speaker and to be positioned in the rear sound box, and detachably fitted to the speaker, for inverting a phase of a particular frequency of sound among sound generated in a back surface of the speaker, and presenting the inverted sound, thereby permitting, not only to change of the duct only for phase inversion of a desired frequency of a sound, but also to discharge of the phase inverted sound to the front of the speaker system for reducing a loss of a sound pressure.

27 Claims, 7 Drawing Sheets

SPEAKER SYSTEM IN DISPLAY

BACKGROUND OF THE INVENTION

1. Field of the Invention

The present invention relates to a speaker system in a display, and more particularly, to a speaker system in a display, in which a structure of the speaker system is changed to a duct change type, for easy phase inversion of a particular frequency of sound generated from a back surface of a speaker.

2. Background of the Related Art

A related art speaker system in a display and operation thereof will be explained with reference to FIG. 1.

Referring to FIG. 1, the related art speaker system of a track type is provided with a track type speaker 1 (hereafter called as "speaker"), and a rear sound box 2 in rear of the speaker 1. The speaker has a frame 102, a gasket 103 inside of the frame 102, an edge 104 fitted to form a ring on an inside of the gasket 103, a cone paper 105 attached to an inside of the edge 104 in a form of a cone. There is a duct 3*a* in the rear sound box 2 as a unit therewith for inverting a phase of the sound generated from a back surface of the speaker 1. There is a cylindrical speaker system mount 106 on a top of the speaker 1 for coupling the speaker system to a speaker system fastening boss 5 fixed on a cabinet(not shown) of the display, and the speaker system mount 106 has anti-vibration rubber 6 for preventing a vibration transmitted from the speaker system to the cabinet.

The operation of the foregoing related art speaker system will be explained.

When the speaker system is in operation, there is a sound ("A" in the drawing) of a certain frequency band is generated in a front surface of the speaker 1. And, there is another sound ("-A" in the drawing) having the same frequency with, but having a phase opposite to the sound "A" is generated in the back surface of the speaker 1. Therefore, it is required to invert the phase of the sound "-A" generated in the back surface of the speaker 1. The phase inversion is done as the sound "-A" generated in a back surface of the speaker 1 passes through the duct 3*a*, but for only a portion of the sound ("-A") with a particular frequency. The sound with a particular frequency from the duct 3*a* having an inverted phase(represented as "B" in the drawing) reinforces the sound "B" with an identical frequency among the sound "A" from the front surface of the speaker 1, thereby providing a low sound reinforcing effect. The frequency "f" of the sound from the duct 3*a* can be expressed with an equation, below.

$$f = \frac{1}{2\pi}\sqrt{\frac{Sc}{Mp}}$$

Where, Mp denotes mass of air in the duct, which is a function of a length and a sectional area of the duct, and Sc denotes a stiffness of the sound box, which is a function of an internal volume. Therefore, if dimensions of the rear sound box are fixed, that is the internal volume Sc is constant, the frequency of the sound from the duct 3*a* is fixed depending on the length and sectional area of the duct.

However, the formation of the duct 3*a* as a unit with the speaker system in the related art causes the following problems.

The related art speaker system can only invert a particular frequency, to require a new rear sound box 2 when it is desired to invert other particular frequency by changing the length or sectional area of the duct 3*a*, that is impossible as the related art speaker system has unitary duct 3*a* and sound box 3. And, even if a design of the rear sound box 2 itself is changed for fabricating a new rear sound box 2 in an intention to provide a longer duct 3*a*, the provision of the longer duct as much as wanted is very difficult since a drawing out angle of a mold should be taken into consideration.

Moreover, the backward exit of the duct 3*a* from the rear sound box 2 in the related art speaker system causes a sound pressure drop, which weakens a reinforcing power for the sound generated in the front surface.

In summary, the unitary duct 3*a* and sound box 3 permits no change of the duct only, and the backward exit of the duct 3*a* from the rear sound box 2 causes a loss of the sound pressure.

SUMMARY OF THE INVENTION

Accordingly, the present invention is directed to a speaker system in a display that substantially obviates one or more of the problems due to limitations and disadvantages of the related art.

An object of the present invention is to provide a speaker system in a display, in which a duct only can be changed with easy for inverting a phase of a desired frequency, and an inverted sound is made to be discharged to forward for eliminating a sound pressure loss.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the speaker system in a display includes a speaker for presenting a sound, a rear sound box coupled to a back of the speaker, and a changeable duct disposed to pass through a front surface of the speaker and to be positioned in the rear sound box, and detachably fitted to the speaker, for inverting a phase of a particular frequency of sound among sound generated in a back surface of the speaker, and presenting the inverted sound.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention:

In the drawings:

FIGS. 2~4 illustrate perspective view of speaker systems of a display in accordance with preferred embodiments of the present invention, wherein FIG. 2 illustrates a disassembled perspective view of a speaker system for showing a process of assembly;

FIG. 3 illustrates a perspective view of a speaker system after completion of assembly;

FIG. 4 illustrates a perspective view of a speaker system with a partial cut away view for showing an internal structure;

DETAILED DESCRIPTION OF THE PREFERRED EMBODIMENT

Figure 1:
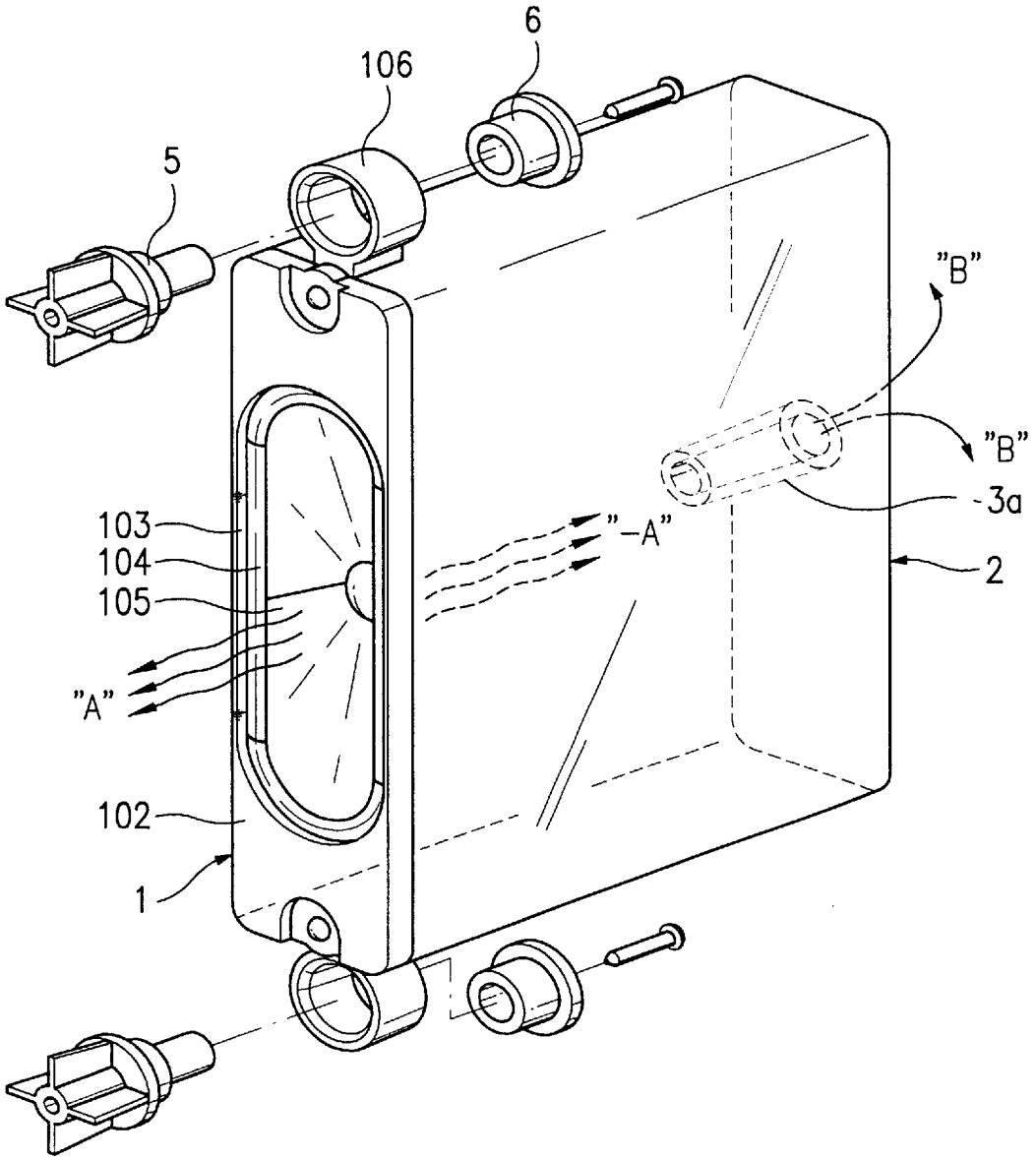
FIG.1 Prior Art
FIG. 1 illustrates a perspective view of a related art speaker system in a display.
Figure 2:
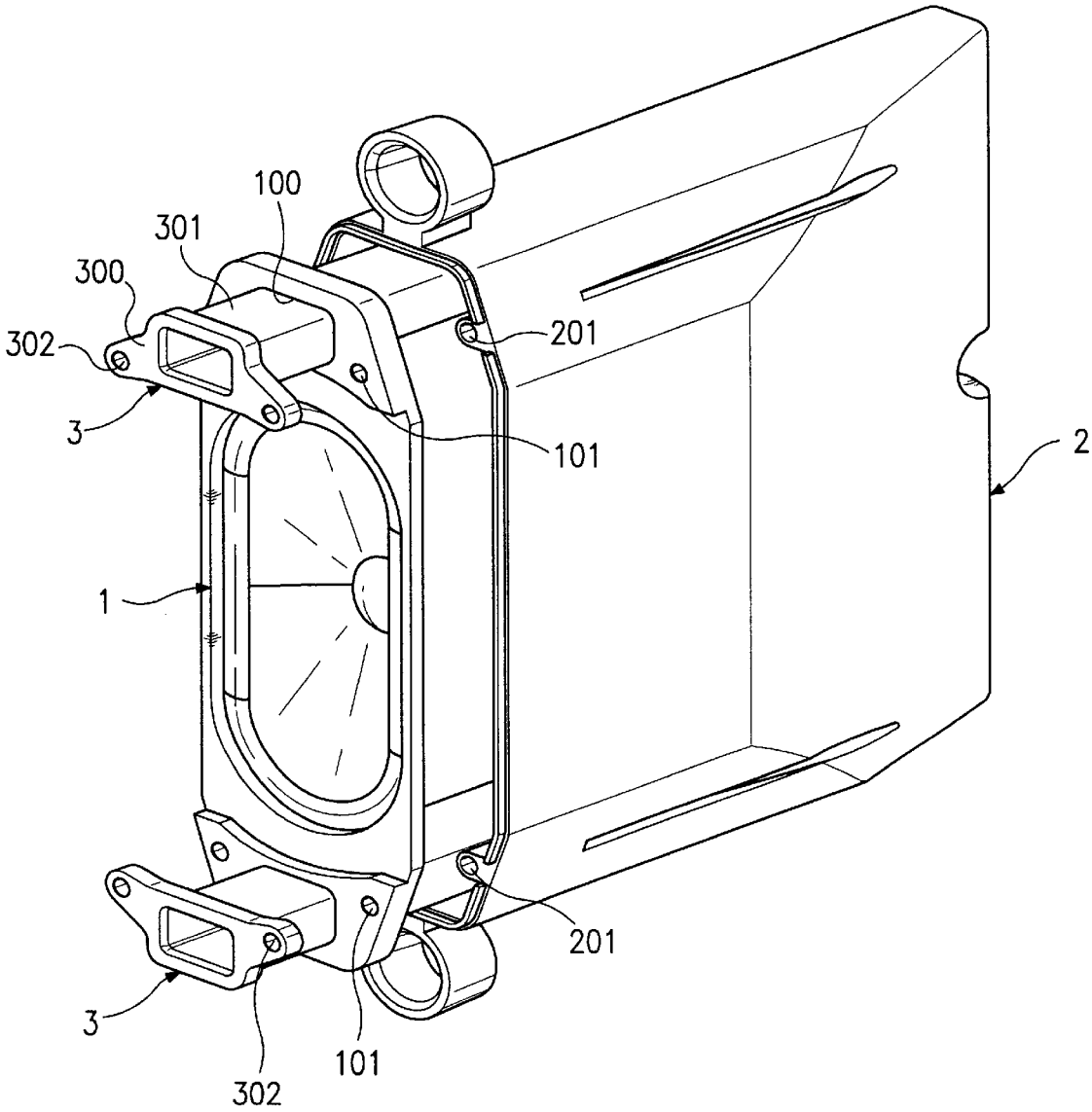
Figure 3:
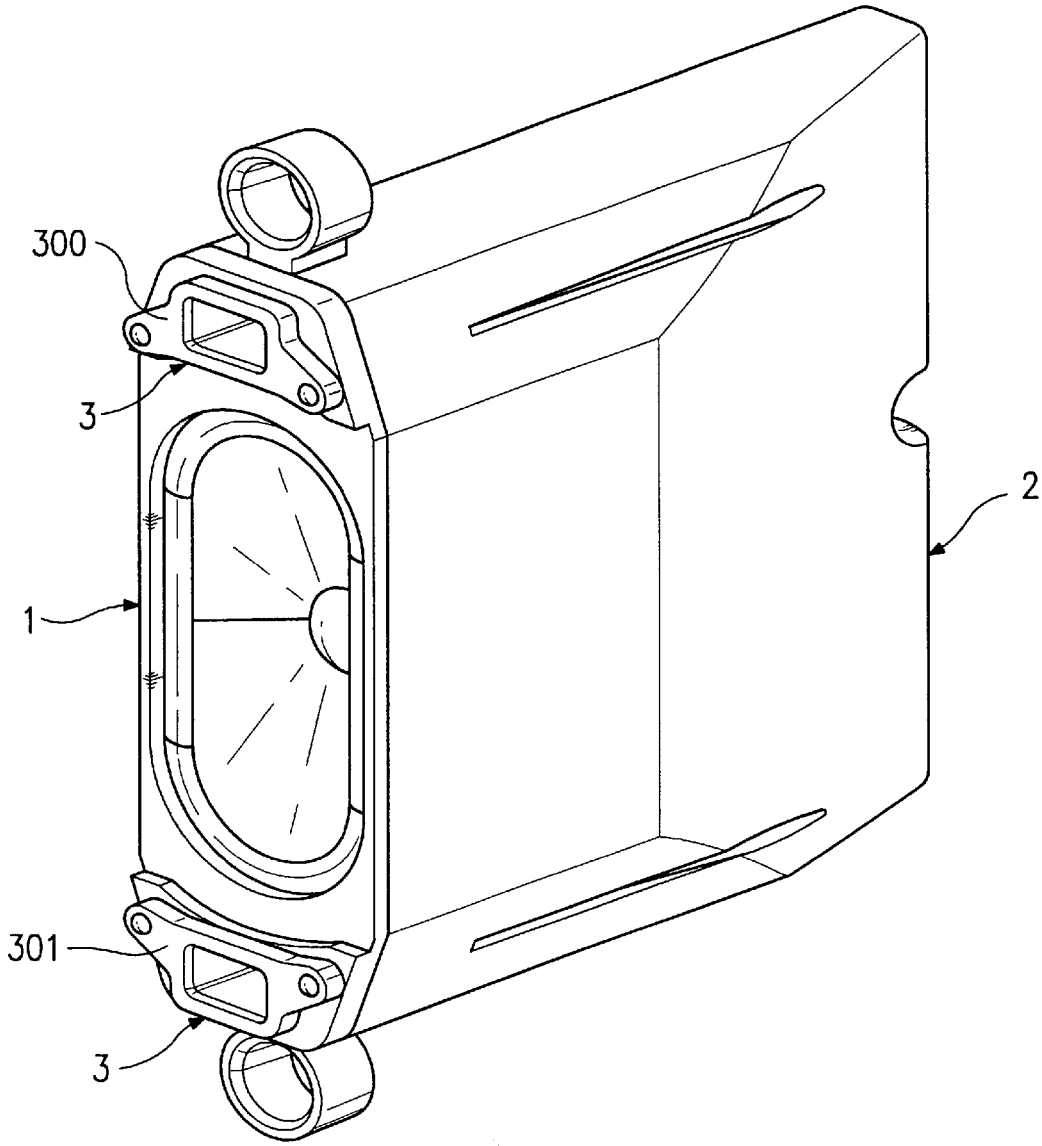
Figure 4:
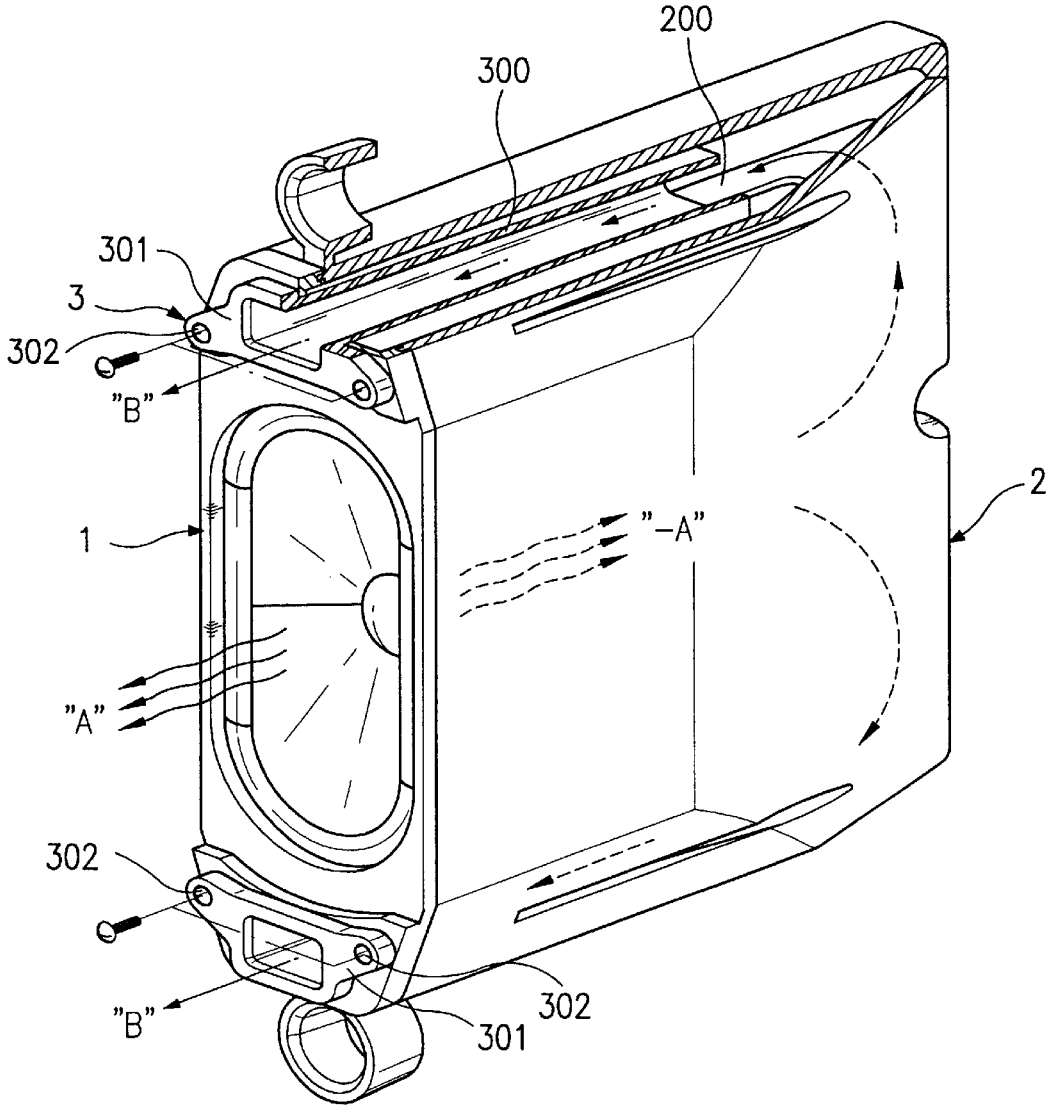

Reference will now be made in detail to the preferred embodiments of the present invention, examples of which are illustrated in the accompanying drawings. FIGS. 2~4 illustrate perspective view of speaker systems of a display in accordance with preferred embodiments of the present invention, wherein FIG. 2 illustrates a disassembled perspective view of a speaker system for showing a process of assembly, FIG. 3 illustrates a perspective view of a speaker system after completion of assembly, and FIG. 4 illustrates a perspective view of a speaker system with a partial cut away view for showing an internal structure.

The speaker system of a display in accordance with a preferred embodiment of the present invention includes a speaker 1 for generating a sound, a rear sound box 2 coupled to a back portion of the speaker 1, and a changeable duct 3 detachably fitted to the speaker 1 passed through a front surface of the speaker 1 and disposed in the rear sound box 2 for inverting a phase of a sound with a particular frequency in sound generated in a back surface of the speaker 1. In this instance, the changeable duct 3 had a fixed length and flow sectional area, and fitted to an upper portion and a lower portion of the speaker system. The changeable duct 3 of a tubular form has a duct part 300 passed through the speaker 1 and disposed in the rear sound box 2 for making the rear sound box 2 and a front of the speaker 1 to be in communication, and a flange 301 at a front of the duct part 300 for being caught at an edge of a duct assembly hole 100 in a front surface of the speaker 1 to define an insertion position of the duct 3. The changeable duct 3 is fastened to a front surface of the speaker 1 by a screw 4 passed through one side of the flange 301 and fastened to the speaker 1. And, there is a duct holder 200 in the rear sound box 2 for guiding the insertion of the changeable duct 3 through the duct assembly hole 100 in the front surface of the speaker 1, and supporting an outside surface of the duct part 300 of the exchangeable duct 3 inserted through the duct assembly hole 100 in the front surface of the speaker 1, to prevent the changeable duct 3 from being shaken during the speaker system is in operation.

Figure 5:
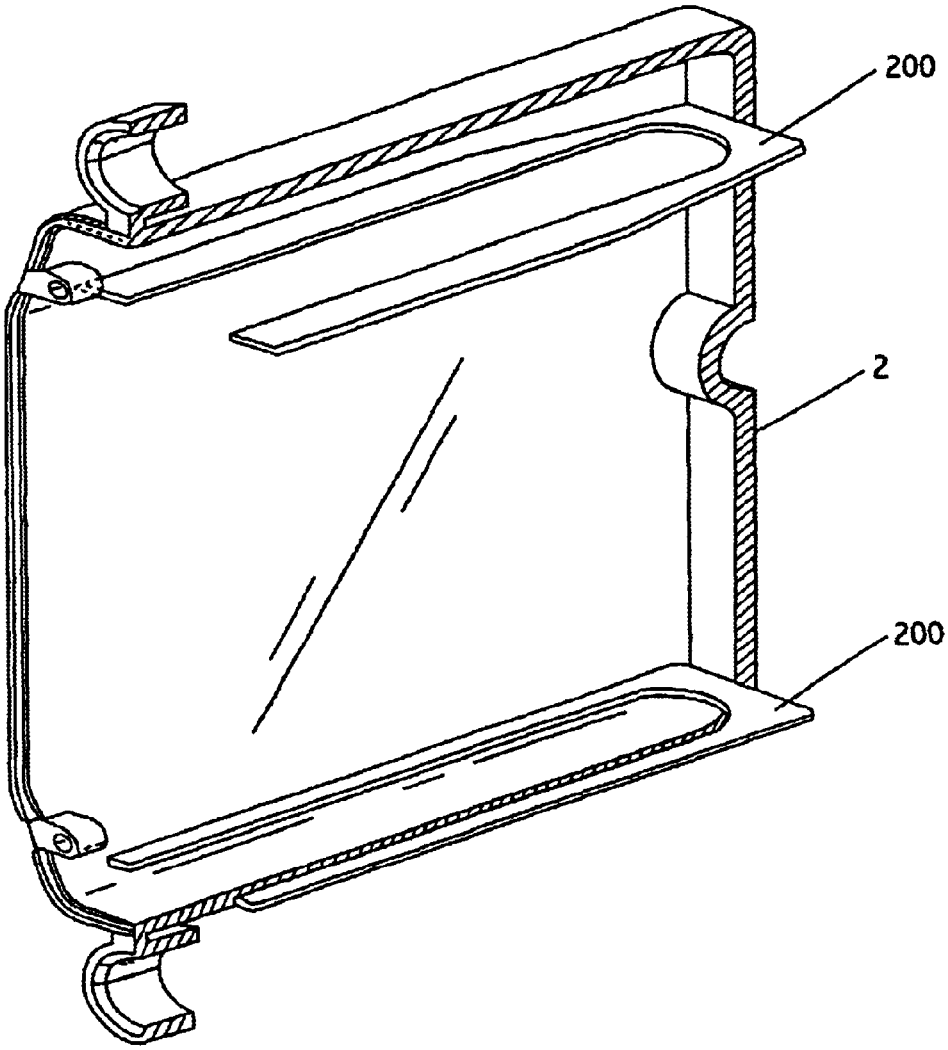
FIG. 5 illustrates a perspective view of a speaker system with a partial cut away view for showing a duct holder.

An embodiment of the duct holder 200 is shown in FIG. 5 and includes a ridge protruding from an interior surface of the rear sound box 2. The duct holder 200 is configured to form a shelf-like or ridge-like structure to contact and reduce vibration of the duct 300.

An assembly process and operation of the aforementioned speaker system in a display of the present invention will be explained.

The changeable ducts 3 each with a sectional area and a length are inserted through the duct assembly holes 100 in an upper portion and a lower portion of the speaker 1 respectively, until the flanges 301 at fore ends of the changeable ducts 3 are brought into contact with the edge of the duct assembly holes 100. After matching the speaker 1 and the changeable ducts 3 with the rear sound box 2 under a state the changeable duct 3 and the speaker 1 are thus preassembled, screws 4 are fastened through screw holes 302, 101, and 201 under a state the screw holes 302 in the flanges 301 of the changeable duct 3, the screw holes 101 in the front surface of the speaker 1, and screw holes 201 in the rear sound box 2 are aligned, to complete assembly of the speaker system. That is, the speaker system of the present invention is assembled as the speaker 1, the rear sound box 2 and the exchangeable ducts 3 are fastened by the same screws passing through them at a time, thereby improving assembly work. As assembly of the speaker system of the present invention is completed, the outside surfaces of the duct parts 300 located in the rear sound box 2 are supported by the duct holder 200 on the rear sound box 2, to prevent the changeable ducts 3 from being shaken during the speaker system is in operation.

Figure 6:
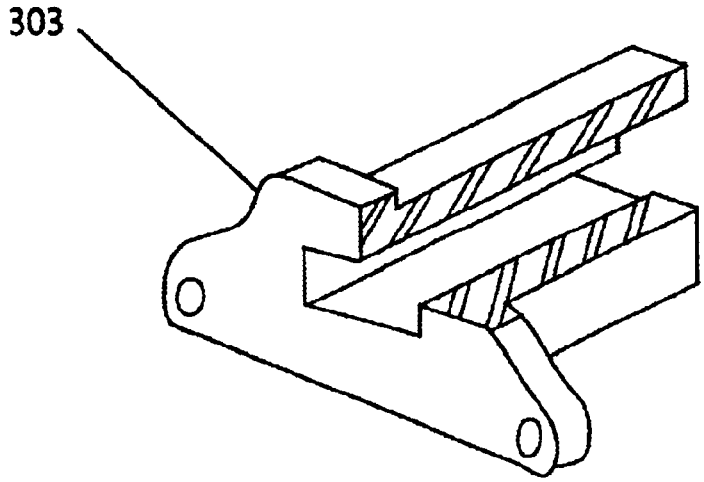
FIG. 6 illustrates a perspective view of a second changeable duct part having different length and flow sectional area.
Figure 7:
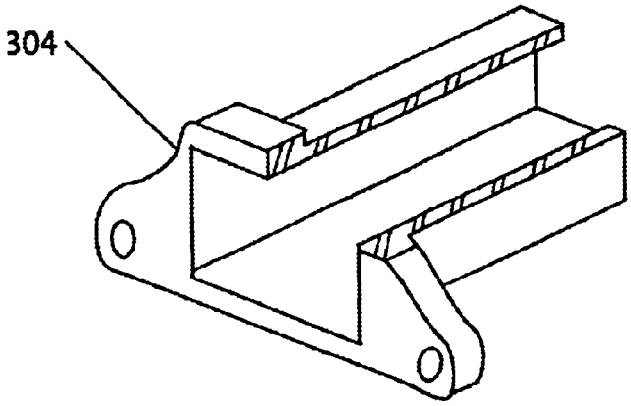
FIG. 7 illustrates a perspective view of a second changeable duct part having different length and flow sectional area.

As examples of second changeable duct parts, FIGS. 6 and 7 show embodiments of second changeable duct parts, 303 and 304, respectively, having smaller and larger flow sectional areas and shorter lengths than the changeable duct 300 of FIGS. 2–4. Other changeable ducts may have other flow sectional areas and/or lengths compared to the examples shown here.

Alike the related art speaker system, the speaker system of the present invention has a sound "-A" of the same frequency with, but of a phase opposite to a sound "A" occurred in a back surface of the speaker 1, a phase of which is required to be inverted. In this instance, the phase of the sound "-A" occurred in the back surface of the speaker 1 is inverted as the sound passes through the changeable duct 3 detachably provided to the speaker system of the present invention. That is, of the sound "-A" occurred in the back surface of the speaker 1, only a sound of a particular frequency "-B" has the phase inverted as the sound "-A" passes through the changeable duct 3, and reinforces a sound "B" of the same frequency among the sound "A" occurred in the front surface of the speaker 1, thereby providing a low frequency sound reinforcing effect. As shown in FIG. 4, since the phase inverted sound "B" in the speaker system of the present invention is forwarded to the front of the speaker 1 through rear of the changeable duct 3, different from the related art speaker system, the phase inverted sound "B" is involved in no pressure loss, such that the reinforcing power of the phase inverted sound "B" to the sound occurred in the front surface of the speaker 1 is significantly enhanced.

In the meantime, when it is intended to change the frequency desired to invert to another frequency, the speaker system of the present invention permits an easy change of the frequency by detaching and changing the changeable duct, as follows.

First, the changeable duct 3 fastened by screws to the upper and lower portions of the front surface of the speaker 1 in the speaker system is separated from the speaker system. That is, after the screws 4 fastened to the flange 301 is unscrewed by using a tool, such as a driver, when the changeable duct 3 is pull forward, the changeable duct 3 is easily separated from the speaker system. Thus, after the changeable duct 3 is separated from the speaker system, a new changeable duct having different length and flow sectional area set therein according to the frequency desired to invert is assembled by the same method as the foregoing assembly steps. Once the duct in the speaker system is thus changed, the frequency of the sound of which phase is inverted as the sound passes through the changeable duct when the speaker system is in operation will be also changed. In short, when dimensions of the rear sound box 2 are fixed, the frequency "f" of the sound passes through the duct is dependent on the flow sectional area or length of the duct, the speaker system of the present invention can change a frequency of a sound of which phase is desired to invert with easy by separating, and changing the changeable duct having lengths or flow sectional areas different from each other. In the present invention, there may be damping members(not shown) provided between an inside surface of the duct assembly holes 100 of the changeable duct 3 in the speaker 1 and an outside surface of the duct to be in contact with the inside surface of the duct assembly holes 100 of the changeable duct 3, and between an inside surface of the duct holder 200 for the changeable duct 3 in the rear sound box 2 and an outside surface of the duct to be in contact with the inside surface of the duct holder 200 for the changeable duct 3 for preventing transmission of a vibration of the changeable duct 3 occurred during operation of the speaker system of the present invention to the speaker and the rear sound box.

The speaker system in a display of the present invention has the following advantages.

The duct in the speaker system of the present invention is made detachable from the rear sound box, and a duct opening therein to face front of the speaker system, to permit, different from the related art speaker system in which the entire rear sound box should be redesigned and fabricated newly, not only change of the duct only for phase inversion of a desired frequency of a sound, but also discharge of the phase inverted sound to the front of the speaker system for reducing a loss of a sound pressure. In short, since the speaker system of the present invention can change a frequency band of which phase is desired to be inverted with easy only by duct change, the various problems of the related art caused by redesigning and refabrication of the rear sound box itself are solved.

It will be apparent to those skilled in the art that various modifications and variations can be made in the speaker system in a display of the present invention without departing from the spirit or scope of the invention. Thus, it is intended that the present invention cover the modifications and variations of this invention provided they come within the scope of the appended claims and their equivalents.

What is claimed is:

1. A speaker system in a display, comprising:

a speaker for presenting a sound;

a rear sound box fixed to a back of the speaker; and a changeable duct removably fixed to a front surface of the speaker and configured to pass through a front surface of the speaker and to be positioned in the rear sound box for inverting a phase of a particular frequency of sound among sound generated in a back surface of the speaker, and presenting the inverted sound, wherein the changeable duct comprises:

a duct part of a tube form passed through the speaker and disposed in the rear sound box for making the rear sound box and the front of the speaker in communication;

a flange part at a front end of the duct part for being caught at an edge surface of the speaker; and duct assembly holes formed in a front surface of the speaker to define an insertion position of the duct; and a duct holder disposed in the rear sound box for guiding the changeable duct inserted through the duct assembly hole in the front surface of the speaker, and supporting an outside surface of the changeable duct inserted through the duct assembly hole in the front surface of the speaker to prevent shaking of the changeable duct during operation of the speaker, wherein the duct holder is configured to guide and support ducts of different cross-sectional area and length such that the changeable duct can be removed and replaced with a changeable duct having a different cross-sectional area and length, and wherein the duct holder comprises a ridge fixed to an interior surface of the rear sound box for supporting the changeable duct.

2. The speaker system as claimed in claim 1, wherein the changeable duct is provided to an upper portion and a lower portion of the speaker system, separately.

3. The speaker system as claimed in claim 1, wherein the changeable duct is fastened to the front surface of the speaker by screws fastened to the speaker through one side of the flange in the changeable duct.

4. The speaker system as claimed in claim 1, further comprising damping members provided between an inside surface of the duct assembly holes of the changeable duct in the speaker and an outside surface of the duct to be in contact with the inside surface of the duct assembly holes of the changeable duct, and between an inside surface of the duct holder for the changeable duct in the rear sound box and an outside surface of the duct to be in contact with the inside surface of the duct holder for the changeable duct for preventing transmission of a vibration of the changeable duct occurred during operation of the speaker system to the speaker and the rear sound box.

5. A speaker system in a display, comprising:

a framework;

a speaker mounted in said framework;

a rear sound box mechanically coupled to a back of the framework;

at least one changeable acoustic waveguide acoustically coupled to a rear of the speaker and a front of the speaker, wherein the framework does not form part of the at least one waveguide; and at least one waveguide holder disposed in the rear sound box and configured to support the at least one changeable acoustic waveguide, wherein the at least one wave guide holder is configured to receive acoustic waveguides of different cross-sectional area and length such that the at least one changeable acoustic waveguide can be removed and replaced with an acoustic waveguide having a different cross-sectional area and/or length, and wherein the at least one waveguide holder comprises a ridge attached to at least one of an interior surface of a sidewall and an interior surface of a rearwall of the rear sound box.

6. The speaker system of claim 5, wherein the at least one changeable acoustic waveguide comprises first and second changeable acoustic waveguides, and wherein the at least one waveguide holder comprises first and second waveguide holders disposed in the rear sound box and configured to support the first and second changeable acoustic waveguides, respectively.

7. The speaker system of claim 6, wherein said first changeable acoustic waveguide is detachably mounted to an upper portion of said framework, and said second changeable acoustic waveguide is detachably mounted to a lower portion of said framework.

8. The speaker system of claim 5, wherein an end of said at least one changeable acoustic waveguide terminates in substantially the same plane as said speaker is positioned.

9. The speaker system of claim 5, wherein a front surface of said speaker is directly acoustically coupled to free space.

10. The speaker system of claim 5, wherein the at least one changeable acoustic waveguide is configured to be removable from said framework without disassembly of said rear sound box from said framework.

11. The speaker system of claim 5, wherein the at least one changeable acoustic waveguide is configured to be removable from said framework without disassembly of said speaker system.

12. The speaker system of claim 5, wherein the waveguide holder is configured to dampen vibration of the at least one changeable acoustic waveguide during operation of the speaker.

13. The speaker system of claim 5, wherein the at least one changeable duct includes a duct part of a tube form passed through the speaker and disposed in the rear sound box for making the rear sound box and the front of the speaker in communication, and a flange part at a front end of the duct part for being caught at an edge surface of the duct assembly holes formed in a front surface of the speaker to define an insertion position of the duct and the at least one waveguide holder comprises a duct holder disposed in the rear sound box for guiding the changeable duct inserted through the duct assembly hole in the front surface of the speaker, and supporting an outside surface of the changeable duct inserted through the duct assembly hole in the front surface of the speaker to preventing shaking of the changeable duct during operation of the speaker.

14. A speaker system in a display, comprising:

a framework;

a speaker mounted in said framework;

a rear sound box mechanically coupled to a back of the framework;

first and second changeable acoustic waveguides acoustically coupled to a rear of the speaker and a front of the speaker; and first and second waveguide holders disposed in the rear sound box and configured to support the first and second changeable acoustic waveguides, respectively, wherein the first and second waveguide holders are configured to support, respectively, first and second changeable acoustic waveguides of different cross-sectional area and length such that the first and second changeable acoustic waveguides can be removed and replaced with first and second changeable acoustic waveguides of a different cross-sectional area and length, and wherein each of the first and second waveguide holders comprise a ridge attached to at least one of an interior surface of a sidewall and an interior surface of a rearwall of the rear sound box.

15. The speaker system of claim 14, wherein the first acoustic waveguide is mounted in an upper portion of said framework and the second changeable acoustic waveguide is mounted in a lower portion of said framework.

16. The speaker system of claim 14, wherein the first and second changeable acoustic waveguides are not located in a central portion of the framework where the speaker is mounted.

17. The speaker system of claim 14, wherein the first and second waveguide holders are configured to dampen vibration of the first and second changeable acoustic waveguides, respectively, during operation of the speaker.

18. The speaker system of claim 14, wherein the first and second changeable ducts each includes a duct part of a tube form passed through the speaker and disposed in the rear sound box for making the rear sound box and the front of the speaker in communication, and a flange part at a front end of the duct part for being caught at an edge surface of the duct assembly holes formed in a front surface of the speaker to define an insertion position of the duct and the first and second waveguide holders each comprises a duct holder disposed in the rear sound box for guiding the changeable duct inserted through the duct assembly hole in the front surface of the speaker, and supporting an outside surface of the changeable duct inserted through the duct assembly hole in the front surface of the speaker to preventing shaking of the changeable duct during operation of the speaker.

19. A speaker system in a display, comprising:

a speaker for presenting a sound;

a rear sound box fixed to a back of the speaker; and a changeable duct disposed to pass through a front surface of the speaker and to be positioned in the rear sound box, and detachably fitted to the speaker, for inverting a phase of a particular frequency of sound among sound generated in a back surface of the speaker, and presenting the inverted sound, wherein the changeable duct comprises:

a duct part of a tube form passed through the speaker and disposed in the rear sound box for making the rear sound box and the front of the speaker in communication;

a flange part at a front end of the duct part for being caught at an edge surface of the speaker; and duct assembly holes formed in a front surface of the speaker to define an insertion position of the duct; and a duct holder disposed in the rear sound box for guiding the changeable duct inserted through the duct assembly hole in the front surface of the speaker, and supporting an outside surface of the changeable duct inserted through the duct assembly hole in the front surface of the speaker to prevent shaking of the changeable duct during operation of the speaker, wherein the frequency response of the speaker system can be adjusted by removing the changeable duct and replacing it with another changeable duct without use of an adaptive electrical circuit, and wherein the duct holder comprises a ridge-like structure fixed to an interior surface of the rear sound box.

20. The speaker system claim 19, wherein the duct holder is configured to support a rear end of a changeable duct.

21. The speaker system claim 19, wherein the changeable duct may be removed and replaced with a second changeable duct comprising a larger diameter.

22. A speaker system in a display, comprising:

a framework;

a speaker mounted in said framework;

a rear sound box mechanically coupled to a back of the framework;

at least one changeable acoustic waveguide acoustically coupled to a rear of the speaker and a front of the speaker, wherein the framework does not form part of the at least one waveguide; and at least one waveguide holder disposed in the rear sound box and configured to support the at least one changeable acoustic waveguide, wherein the frequency response of the speaker system can be adjusted by removing the at least one changeable acoustic waveguide and replacing it with another changeable acoustic waveguide without use of an adaptive electrical circuit, and wherein the at least one waveguide holder comprises a ridge-like structure fixed to an interior surface of the rear sound box.

23. The speaker system claim 22, wherein the waveguide holder is configured to support a rear end of a changeable duct.

24. The speaker system of claim 22, wherein the changeable acoustic waveguide may be removed and replaced with a second changeable acoustic waveguide comprising a larger diameter.

25. A speaker system in a display, comprising:

a framework;

a speaker mounted in said framework;

a rear sound box mechanically coupled to a back of the framework; and first and second changeable acoustic waveguides acoustically coupled to a rear of the speaker and a front of the speaker; and first and second waveguide holders disposed in the rear sound box and configured to support the first and second changeable acoustic waveguides, respectively, wherein the frequency response of the speaker system can be adjusted by removing the first and second changeable acoustic waveguides and replacing them with third and fourth changeable acoustic waveguides of different dimensions without use of an adaptive electrical circuit, and wherein each of the first and second waveguide holders comprises a ridge-like structure fixed to an interior surface of the rear sound box.

26. The speaker system claim 25, wherein the first and second waveguide holders are configured to support rear ends of first and second changeable acoustic waveguides, respectively.

27. The speaker system of clam 25, wherein the first and second changeable acoustic waveguides may be removed and replaced with alternate first and second changeable acoustic waveguides comprising larger diameters.

* * * * *